US007616905B2

(12) United States Patent
Masubuchi

(10) Patent No.: US 7,616,905 B2
(45) Date of Patent: Nov. 10, 2009

(54) IMAGE FORMING APPARATUS, CARTRIDGE OF IMAGE FORMING APPARATUS, CARTRIDGE MOUNTING METHOD

(75) Inventor: Yukio Masubuchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 398 days.

(21) Appl. No.: 11/689,580

(22) Filed: Mar. 22, 2007

(65) Prior Publication Data

US 2008/0013967 A1 Jan. 17, 2008

(30) Foreign Application Priority Data

Jul. 12, 2006 (JP) ..... 2006191570

(51) Int. Cl.
*G03G 15/00* (2006.01)

(52) U.S. Cl. ..... 399/12; 399/24; 399/25; 399/111

(58) Field of Classification Search ..... 399/8, 399/9, 12, 13, 24, 25, 27, 107, 111, 262; 222/DIG. 1

See application file for complete search history.

(56) References Cited

U.S. PATENT DOCUMENTS 7,346,285 B2 * 3/2008 Nagahama et al. ..... 399/8

FOREIGN PATENT DOCUMENTS

JP 200453761 2/2004
JP 2004-309945 * 11/2004

* cited by examiner

*Primary Examiner*—Hoan H Tran
(74) *Attorney, Agent, or Firm*—Gauthier & Connors LLP

(57) ABSTRACT

A cartridge storing a recording agent includes an opening through which the stored recording agent is discharged, and a cover member closing the opening. Further, a non-contact IC tag that stores information concerning the cartridge is attached to the cartridge. An image forming apparatus includes a communication unit that communicates with the IC tag for transmitting and receiving information, and an actuator that operates on the basis of the information obtained by this communication. The operation for opening the cover member is controlled by this actuator.

16 Claims, 6 Drawing Sheets

IMAGE FORMING APPARATUS, CARTRIDGE OF IMAGE FORMING APPARATUS, CARTRIDGE MOUNTING METHOD

CROSS-REFERENCE TO RELATED APPLICATIONS

This application is based on and claims priority under 35 USC 119 from Japanese Patent Application No. 2006-191570, filed on Jul. 12, 2006.

BACKGROUND

1. Technical Field

The present invention relates to an image forming apparatus such as a copying machine and a printer, and more particularly relates to mismounting of a cartridge that is a replaceable component storing a recording agent.

2. Related Art

Image forming apparatuses such as copying machines and printers form an image on a medium such as a sheet by using a recording agent such as toner and ink, on the basis of an original document or image information transmitted from an external apparatus. A recording agent, that is a consumable item, needs to be supplemented. For supplementing a recording agent, a method in which a container called a cartridge or a bottle storing a recording agent is mounted in an image forming apparatus and is replenished has been known. The container is removed when it becomes empty, and is replaced by a new container that is filled with a recording agent.

Recently, technology in which a replaceable component such as a container of recording agent is provided with a memory device storing information concerning this replaceable component, and setting for the image forming process is changed based on the stored information to thereby perform an image forming process, has been proposed.

SUMMARY

An image forming apparatus in accordance with one aspect of the present invention controls opening and closing of a member that covers an opening through which a recording agent that is stored is discharged, on the basis of information stored in a non-contact IC tag attached to this cartridge.

BRIEF DESCRIPTION OF THE DRAWINGS

Exemplary embodiments of the present invention will be described in detail based on the following figures, wherein.

DETAILED DESCRIPTION

Figure 1:
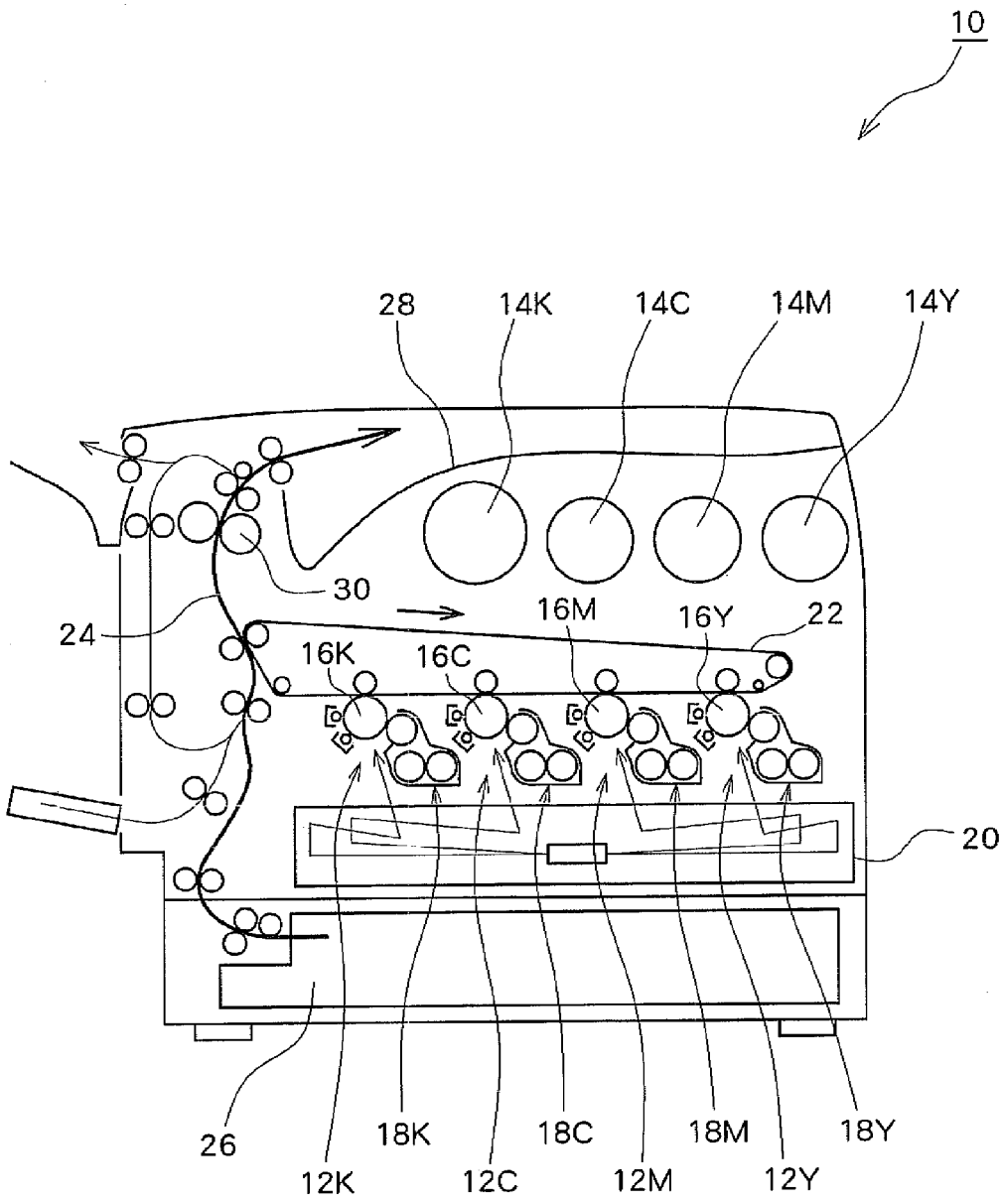
FIG. 1 schematically shows a structure of an image forming apparatus.

Exemplary embodiments of the present invention will be described in detail with reference to the accompanying drawings. FIG. 1 is a view schematically showing the structure inside an electrophotographic image forming apparatus 10 having a tandem type multicolor image forming unit. Specifically, the image forming apparatus 10 includes image forming units 12Y, 12M, 12C, and 12K corresponding to four colors, i.e. yellow (Y), magenta (M), cyan (C), and black (K), respectively, and can therefore form a color image.

Toner is supplied to the image forming units 12Y, 12M, 12C, and 12K corresponding to the above-described four colors from corresponding toner cartridges 14Y, 14M, 14C, and 14K, respectively, that store toners of the respective corresponding colors. Here, the letters "Y, M, C, and K" correspond to the above-described four colors, respectively, and are used with the numerals 12, 14, and so on, only when it is necessary to designate a specific color for explaining the image forming units and the toner cartridges. This will similarly be applied to other constituent elements described below.

The image forming unit 12 includes a photosensitive drum 16Y, 16M, 16C, 16K and a development unit 18Y, 18M, 18C, 18K. A color-separated latent image, obtained by scanning a laser onto an image to be formed with a laser scanning optics 20, is formed on the photosensitive drum 16 corresponding to each color. Then, toner is supplied to each latent image from the corresponding development unit 18 for developing the latent image. These toner images are then transferred (first transfer) onto a common intermediate transfer belt 22 and the images of the respective colors are registered to thereby form a single color toner image. This color toner image thus formed on the intermediate transfer belt 22 is transported by rotation of the belt to a position adjacent to a sheet transport path 24. A sheet is transported from a feed tray 26 through the sheet transport path 24 to an output tray 28. When a sheet passes the position on the sheet transport path 24 that is opposed to the intermediate transfer belt 22, the toner image on the belt 22 is transferred (secondary transfer) onto the sheet. The sheet is further transported and the image on the sheet is heated and pressurized by a fixing roller 30 to fuse and fix the toner.

In the image forming apparatus 10, when toner stored in each toner cartridge is depleted, the empty cartridge is replaced by a toner cartridge filled with toner, whereby supplementing of toner is performed. Among the toner cartridges 14 of four colors, the toner cartridges of yellow, magenta, and cyan, 14Y, 14M, and 14C, have the same shape for unification of the components, and only the color of toner stored therein differs from each other. Accordingly, when a toner cartridge of an incorrect color that should be placed in other image forming units is mounted, there is a possibility that toner of the incorrect color will be supplied to the interior portion of the apparatus, such as into the development unit 18.

To deal with the above disadvantage, the image forming apparatus 10, when a toner cartridge 14 that is not appropriate because of being an incorrect color or other reason is mounted erroneously, prevents the toner stored in the cartridge from being supplied to the interior of the apparatus. For this purpose, a memory device, such as a non-contact IC tag, for example, that electronically stores information concerning the stored toner or the like and that is capable of sending and receiving information via radio is provided on the toner cartridge 14, thereby controlling supply of toner to the interior of the apparatus based on the information stored in the memory device.

Figure 2:
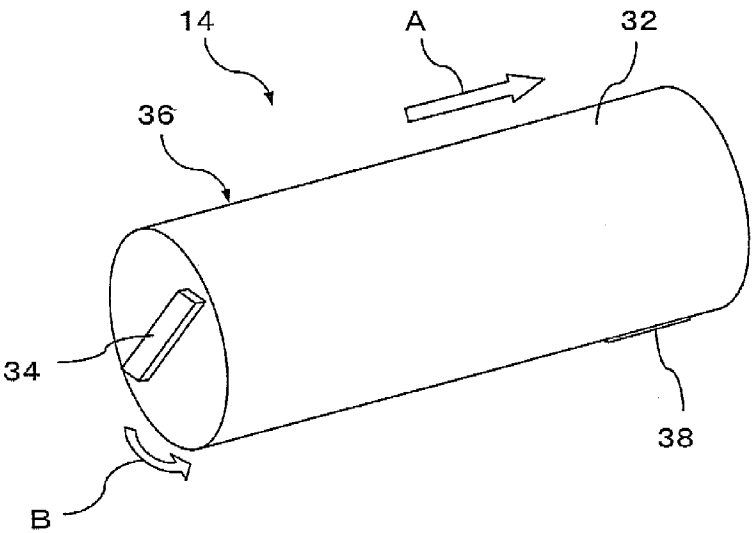
FIG. 2 is a perspective view showing an outer appearance of a toner cartridge.

FIG. 2 is a perspective view showing an outer appearance of the toner cartridge 14. As described above, the yellow, magenta, and cyan toner cartridges 14Y, 14M, and 14C may apparently have the same shape. The black cartridge 14K can have a larger diameter than those of the cartridges of other colors. Even in such a case, the basic structures of these cartridges are similar to each other. As shown in FIG. 2, the toner cartridge 14 includes a toner cartridge body 36 formed by a case 32 having an outer appearance of substantially cylindrical shape and a handle 34 attached to the case 32, and a shutter 38 for opening and closing an opening 40 (see FIG. 3) through which the toner is discharged. For mounting the toner cartridge 14 in the image forming apparatus 10, the toner cartridge 14 is inserted in the direction indicated by the arrow A and is then rotated in the direction indicated by the arrow B by holding the handle 34. The opening 40 is provided in the lower portion of the case 32 on the far side observed in the insertion direction of the toner cartridge 14. When the cartridge 14 is completely mounted, the opening 40 opens in the downward direction, and the toner is discharged from this opening 40 and supplied to the interior of the image forming apparatus 10.

Figure 3:
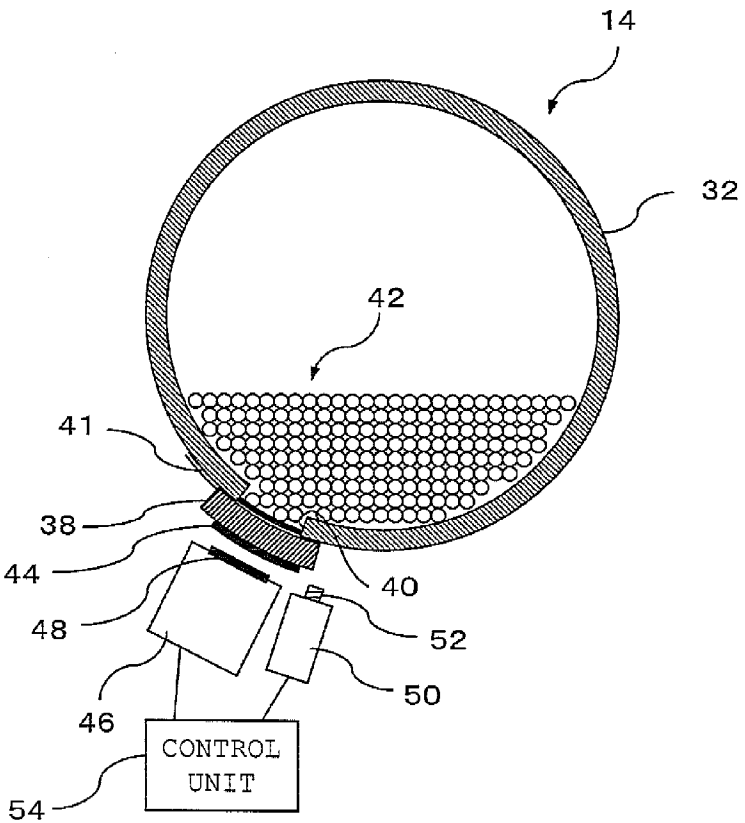
FIG. 3 is a cross sectional view showing a state in which the toner cartridge of FIG. 2 is inserted into the image forming apparatus, particularly a state before the shutter is opened.
Figure 5:
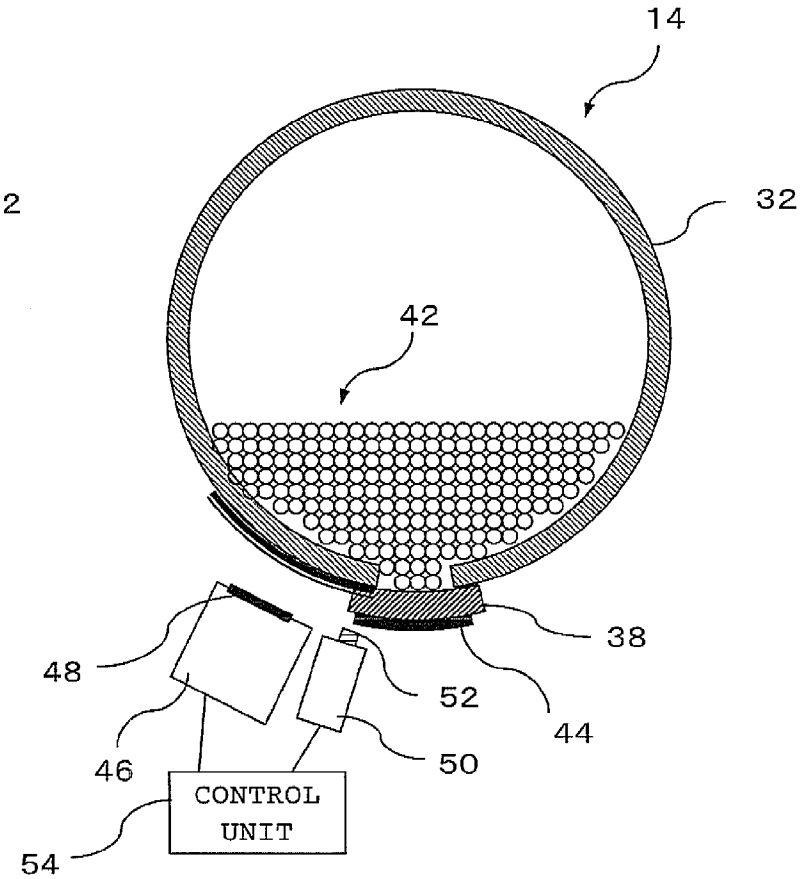
FIG. 5 is a cross sectional view showing a state in which an inappropriate toner cartridge is mounted and therefore the shutter is not opened.
Figure 4:
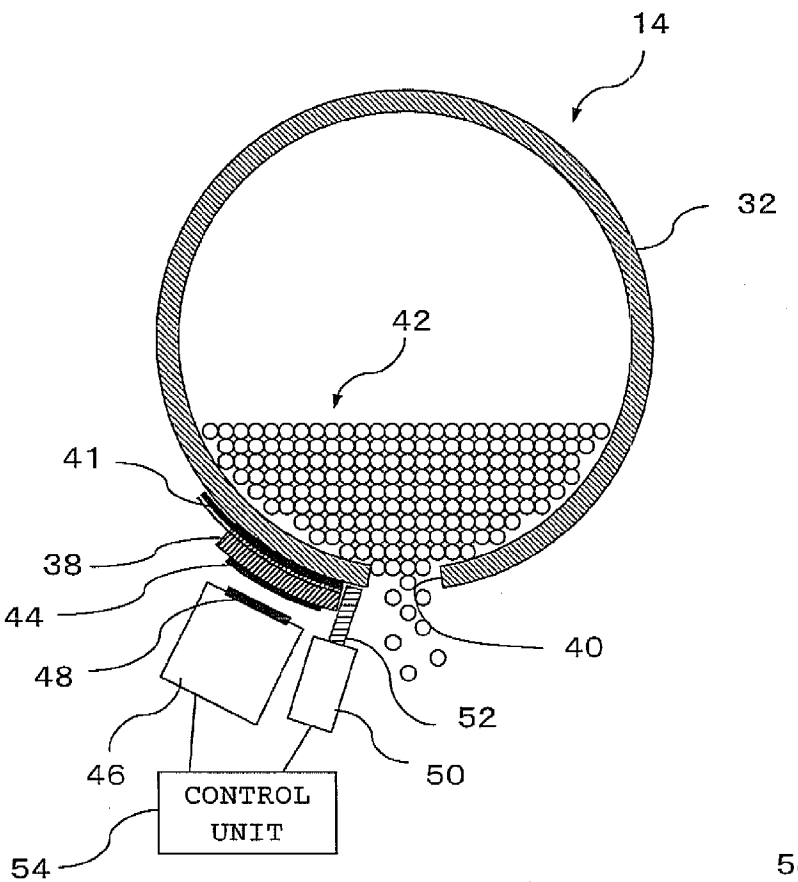
FIG. 4 is a cross sectional view showing a state in which an appropriate toner cartridge is mounted and therefore the shutter is opened.

FIG. 3 to FIG. 5 show a cross section of the toner cartridge 14 through the opening 40. FIG. 3 shows a state in which the toner cartridge 14 is inserted in the direction of the arrow A and is not yet rotated in the direction of the arrow B. Hereinafter, this state will be referred to as an inserted state. Here, a concave engaging portion and a convex engaging portion can be provided on the toner cartridge 14 and the corresponding portion of the image forming apparatus 10 onto which the cartridge 14 is mounted, so that the opening 40 and the shutter 38 of the toner cartridge 14 can be located at predetermined positions when the cartridge 14 is inserted in the direction of the arrow A.

As shown in the drawings, the toner 42 is stored within the case 32 and is prevented from leaking out of the cartridge 14 by closing the opening 40 with the shutter 38. The shutter 38 is slidable along a guide 41 provided on the case 32 so as to open the opening 40. Further, a non-contact IC tag 44 is attached to the shutter 38. The non-contact IC tag 44 contains therein a microcomputer, a semiconductor memory, an oscillation circuit, an antenna, and so on, for communicating information with respect to an external device. In a portion of the body of the image forming apparatus 10 that is opposed to the non-contact IC tag 44 of the toner cartridge 14 that is in the inserted state, a reader/writer (communication unit) 46 for communicating with the tag 44 is provided. The reader/writer 46 includes an antenna 48 on a surface that is opposed to the non-contact IC tag 44. Here, the reader/writer 46 may be disposed in other portions as long as the antenna 48 of the reader/writer 46 is opposed to the non-contact IC tag 44. The non-contact IC tag 44 stores information specific to the toner cartridge to which the non-contact IC tag 44 is attached. The cartridge-specific information includes, for example, the color of the toner stored therein, an ID code for specifying the toner cartridge, a manufacturer, a history of use, and so on.

As described above, when the toner cartridge 14 is in the inserted state as shown in FIG. 3, the antenna 48 is opposed to the non-contact IC tag 44. In other words, the position of the toner cartridge 14 at the time of inserting the toner cartridge for mounting is determined such that the non-contact IC tag 44 attached to the closed shutter 38 is opposed to the antenna 48. The shape of concave and convex portions or the like on the outer periphery of the case 32 can be defined such that the above-described positioning can be achieved.

In FIG. 3, an actuator 50 is further disposed on the body of the image forming apparatus 10 in the vicinity of the lower end of the shutter 38. The actuator 50 includes a retractable pin 2. The pin 52 in its retracted state is shown in FIG. 3, and the pin 52 in its extended state is shown in FIG. 4. As shown in FIG. 4, the pin 52 extends towards the side edge of the shutter 38.

In the state where the toner cartridge 14 is inserted as shown in FIG. 3, the reader/writer 46 communicates with the non-contact IC tag 44, and a control unit 54 determines whether or not the toner cartridge inserted is appropriate based on the information obtained by the communication. When the toner cartridge is determined to be appropriate, the control unit 54 instructs the actuator 50 to cause the pin 52 to extend.

FIG. 4 shows the pin 52 in its extended state and also shows a state in which, with the pin 52 extended, the toner cartridge 14 is rotated in the direction of the arrow B shown in FIG. 2 and is mounted onto the image forming apparatus 10. When the pin 52 contacts the side surface of the shutter 38, further movement of the shutter 38 is prevented by the pin 52 and the shutter 38 stops at this position. On the other hand, the body of the toner cartridge 14 is further rotated, to thereby open the opening 40. Namely, when observed from the body of the toner cartridge 14, the shutter 38 is slid along the guide 41 to open the opening 40, through which the toner stored in the case 32 is discharged and supplied into the image forming apparatus 10. Further, the position of the shutter 38 with regard to the antenna 48 remains unchanged and is maintained at a position where the non-contact IC tag 44 of the shutter 38 can communicate with the reader/writer 46. Thus, even after the toner cartridge 14 is mounted on the image forming apparatus, communication between the non-contact IC tag 44 and the reader/writer 46 can be performed, so that writing and reading of information can be achieved. As such, because the non-contact IC tag 44 and the antenna 48 are opposed to each other both before and after release of the shutter 38, both the release of the shutter 38 based on the information stored in the tag, and the communication with respect to the tag after the toner cartridge is mounted, can be reliably performed.

FIG. 5 shows a state in which the toner cartridge 14 is rotated with the pin 52 not extended. When the control unit 54 determines that the inserted toner cartridge 14 is not appropriate in the inserted state of the cartridge 14 as described above, an instruction for causing the pin 52 to extend is not provided and the body of the toner cartridge 14 is rotated with the shutter 38 covering the opening 40. Thus, the shutter 38 prevents the toner stored in the case 32 from being discharged and supplied into the image forming apparatus 10.

Because the shutter 38 is located on the further portion in the image forming apparatus as described above, whether or not the shutter 38 is opened or closed is not known to the operator who replaces the toner cartridge 14. Accordingly, an indicator such as a lamp that indicates that an appropriate toner cartridge is mounted may be provided on the front side of the image forming apparatus 10. As a matter of course, it is possible to configure the indicator to indicate that an inappropriate toner cartridge is mounted.

FIGS. 6 to 9 show another example toner cartridge having a box shape outer appearance and the operation of mounting the toner cartridge in the image forming apparatus.

Figure 6:
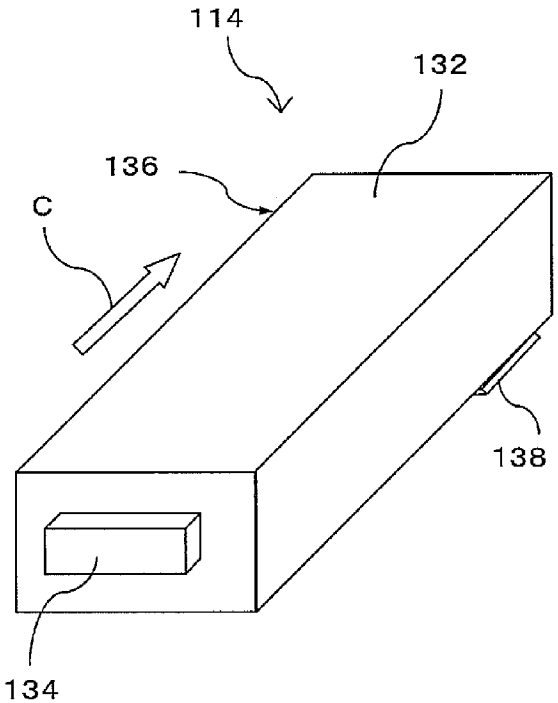
FIG. 6 is a perspective view showing an outer appearance of another example toner cartridge.
Figure 9:
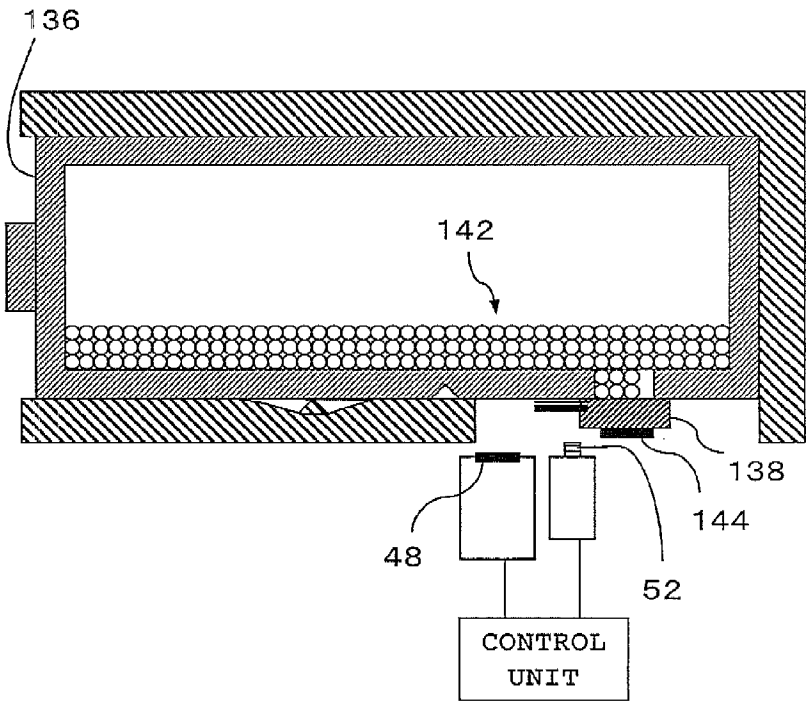
FIG. 9 is a cross sectional view showing a state in which an inappropriate toner cartridge is mounted and therefore the shutter is not opened.
Figure 8:
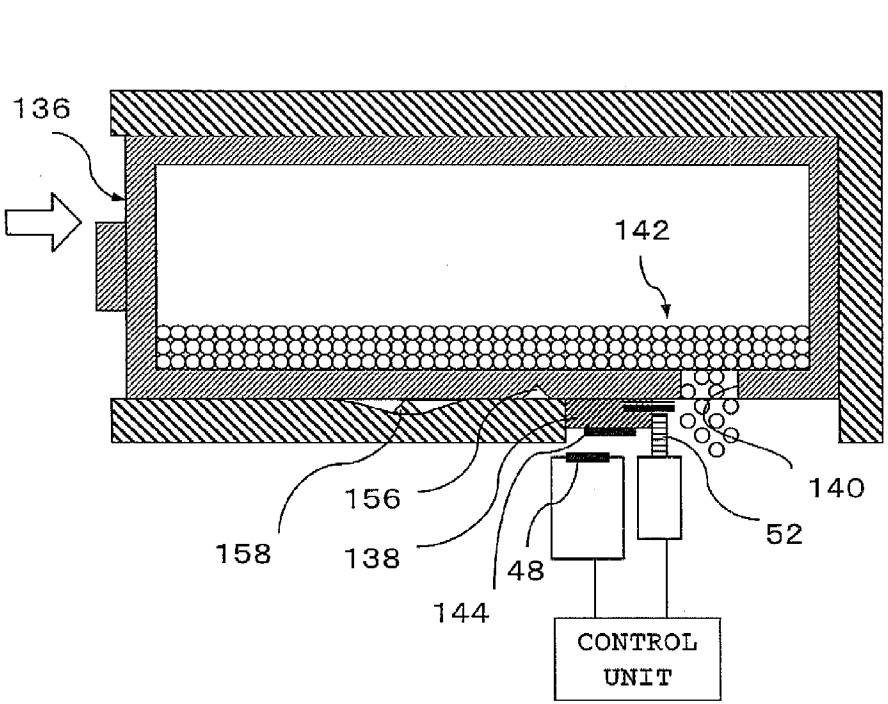
FIG. 8 is a cross sectional view showing a state in which an appropriate toner cartridge is mounted and therefore the shutter is opened.

FIG. 6 is a perspective view showing an outer appearance of a box shape toner cartridge 114. As shown in FIG. 6, the toner cartridge 114 includes a toner cartridge body 136 formed by a case 132 having an outer appearance of substantially box shape and a handle 134 attached to the case 132, and a shutter 138 for opening and closing an opening 140 (see FIG. 7) through which the toner is discharged. For mounting the toner cartridge 114 in the image forming apparatus 10, the toner cartridge 114 is inserted in the direction of the arrow C. When the cartridge 114 is mounted, the opening 140 opens in the downward direction, and the toner is discharged through this opening 140 and supplied into the interior of the image forming apparatus 10.

Figure 7:
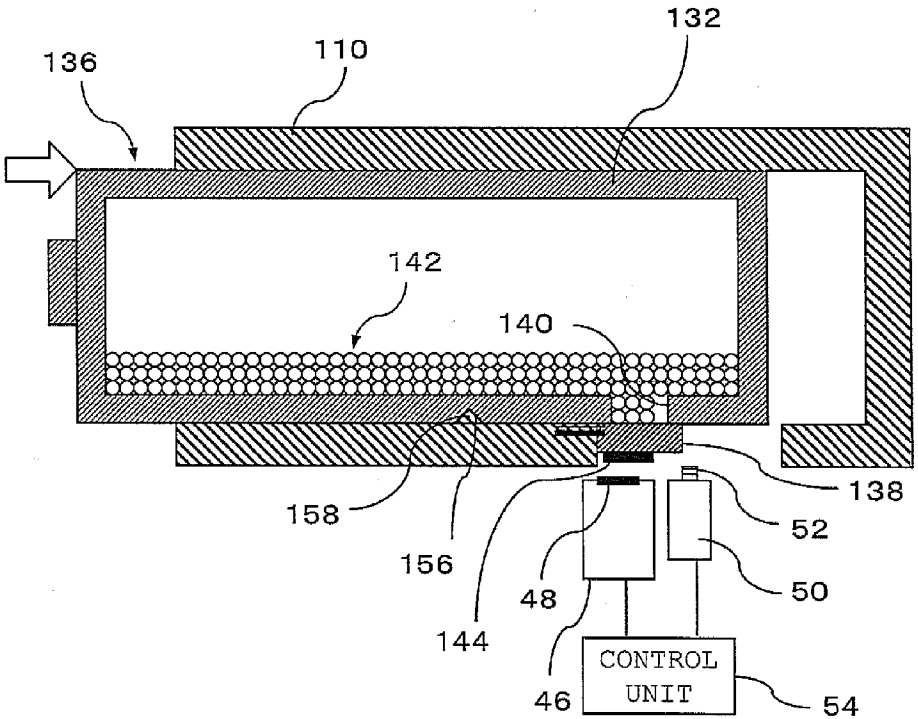
FIG. 7 is a cross sectional view showing a state in which the toner cartridge of FIG. 6 is inserted into the image forming apparatus, particularly a state before the shutter is opened.

FIG. 7 shows a state in which the toner cartridge 114 is inserted into a cartridge mounting unit 110 of the image forming apparatus and particularly shows a state in which an engaging projection 158 formed on the cartridge mounting unit 110 is engaged with an engaging concave portion 156 provided on the case 132. This first-stage inserted position corresponds to the inserted state of the cylindrical toner cartridge 14 described above. Similar to the cylindrical toner cartridge, a non-contact IC tag 144 is attached to the shutter 138. In the inserted position shown in FIG. 7, the non-contact IC tag 144 is in a position opposed to the antenna 48. Here, the antenna 48, the reader/writer 46, the control unit 54, and the actuator 50 have functions similar to those used in the above-described exemplary embodiment concerning the cylindrical toner cartridge 14, and therefore description thereof will be omitted.

When the control unit 54 determines that the inserted toner cartridge is appropriate in the inserted state shown in FIG. 7, the pin 52 is extended to thereby prevent further movement of the shutter 138. In this state, when the toner cartridge 114 is further inserted (the second insertion), the toner cartridge 114 is placed in the mounted position shown in FIG. 8, where the opening 140 is opened to allow the toner 142 stored in the cartridge to be supplied into the interior of the image forming apparatus. When it is determined that the inserted toner cartridge is not appropriate, on the other hand, the pin 52 does not extend, so that the shutter 138 slides along with the toner cartridge body 136, with the opening 140 remaining closed. This prevents supply of inappropriate toner into the apparatus.

As described above, each of the toner cartridges shown in FIGS. 2 and 6 stores a recording agent for the image forming apparatus and includes a shutter covering an opening through which the stored recording agent is discharged. Further, a non-contact IC tag storing information concerning the toner cartridge is attached to the shutter of the toner cartridge. The shutter opens the opening when the mounting operation of the cartridge is performed, with an actuator provided on the body of the image forming apparatus being in contact with the shutter. Also, contact of the actuator with respect to the shutter is controlled based on the information recorded in the non-contact IC tag.

Figure 11:
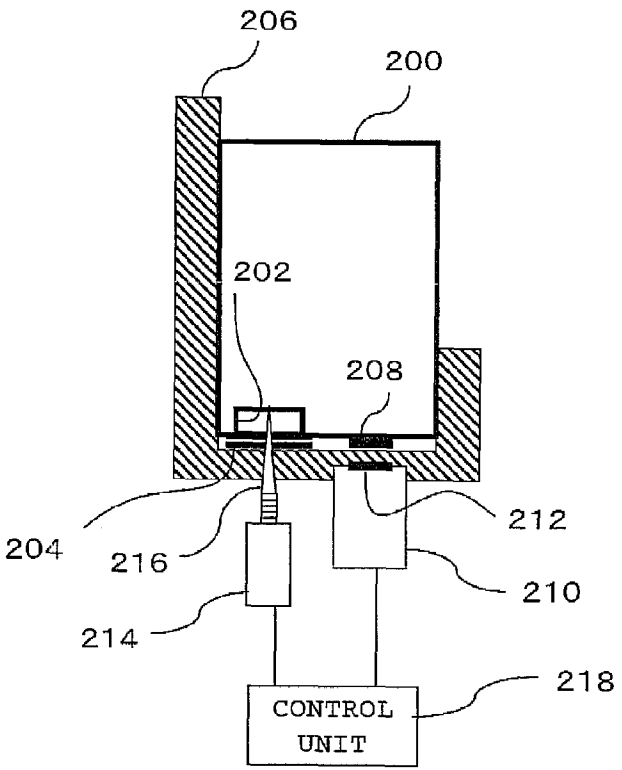
FIG. 11 further shows the exemplary embodiment in which a recording agent is ink.
Figure 10:
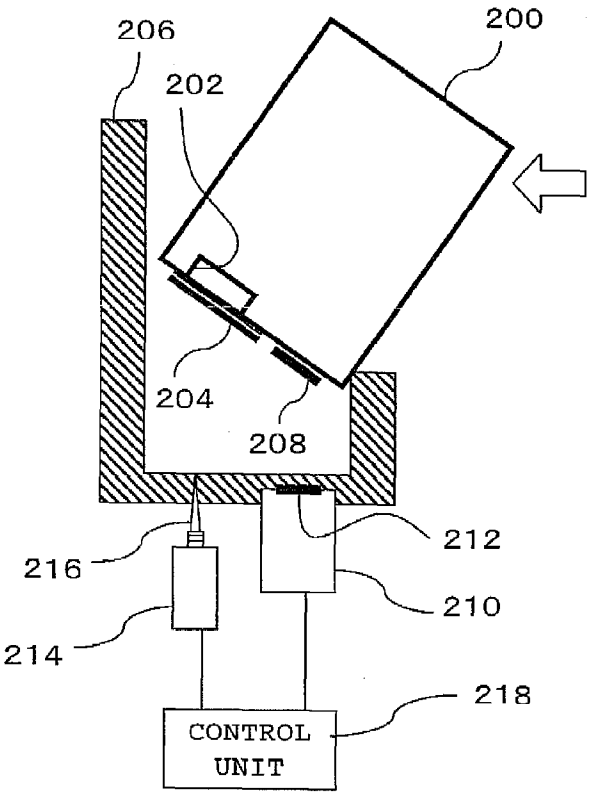
FIG. 10 shows an exemplary embodiment in which a recording agent is ink.

FIGS. 10 and 11 show an exemplary embodiment in which ink is used as a recording agent. An ink tank 200 storing ink has a discharge port 202 through which ink is supplied to the apparatus. Prior to mounting of the ink tank 200, this discharge port 202 is sealed with a cover member, which is an aluminum seal film 204 in this exemplary embodiment. The cover member is not limited to a film member such as a seal film, and may be a stopper having a three-dimensional shape such as a column shape. Further, a non-contact IC tag 208 is attached to the ink tank 200. Here, the non-contact IC tag 208 can be attached to the ink tank 200 such that the tag 208 is opposed to an antenna that communicates with the tag 208 when the ink tank 200 is mounted in the image forming apparatus. In the shown example, the non-contact IC tag 208 is attached to the bottom surface of the ink tank 200 where the discharge port 202 is provided. On a holder 206 on which the ink tank 200 is to be mounted, a reader/writer 210 and an antenna 212 are disposed to communicate with the non-contact IC tag 208. Also, an actuator 214 is disposed at a position on the apparatus that is opposed to the discharge port 202 when the ink tank 200 is mounted. The actuator 214 includes a needle 216 that is extended or retracted on the basis of an instruction issued from a control unit 218.

When the ink tank 200 is mounted in the holder 206, as shown in FIG. 11, the reader/writer 210 communicates with the non-contact IC tag 208, and the control unit 218 determines whether or not the ink tank 200 is appropriate based on the result of communication. If the ink tank 200 is determined to be appropriate, the needle 216 is extended to thereby pierce through the aluminum seal film 204 and open the discharge port 202. If the ink tank 200 is determined to be inappropriate, on the other hand, the needle 206 is not extended to thereby prevent the discharge port 202 from being opened. Thus, supply of inappropriate ink into the image forming apparatus can be prevented.

The foregoing description of the exemplary embodiments of the present invention has been provided for the purposes of the illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical application, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

at least one cartridge that stores a recording agent and can be detachably mounted on a body of the image forming apparatus, the cartridge including an opening through which the recording agent stored in the cartridge is discharged and a cover member that closes the opening;

a non-contact IC tag that is attached to the cartridge for storing information concerning the cartridge to which the non-contact IC tag is attached;

at least one communication unit that is provided on the body of the image forming apparatus and communicates with the non-contact IC tag for transmitting and receiving information;

at least one actuator that comes into contact with the cover member for controlling an opening operation of the cover member; and at least one control unit that controls the actuator based on the information concerning the cartridge obtained through the communication unit.

2. The image forming apparatus according to claim 1, in which the cover member is a shutter that is slidable with respect to a cartridge body, and the shutter is opened when an operation for mounting the cartridge onto the body of the image forming apparatus is performed with the actuator being in contact with the shutter.

3. The image forming apparatus according to claim 2, in which the cartridge has a substantially cylindrical shape, and the cartridge moves in the direction of an axis of the cylinder thereby being inserted into the body of the image forming apparatus, and is then rotated about the axis and mounted, and the shutter is opened by the rotation operation of the cartridge.

4. The image forming apparatus according to claim 2, in which the cartridge has a substantially box shape and is inserted into the body of the image forming apparatus, and the shutter is opened by the inserting operation of the cartridge at an end stage of the inserting operation.

5. The image forming apparatus according to claim 1, in which the cover member is a stopper or a seal film that closes the opening of the cartridge, and the actuator is operated to pierce through the stopper or the seal film to open the opening.

6. The image forming apparatus according to claim 1, in which the information concerning the cartridge stored in the non-contact IC tag includes information concerning the recording agent stored in the cartridge.

7. The image forming apparatus according to claim 1, in which the image forming apparatus can form a multicolor image and includes mounting units corresponding to cartridges of a plurality of colors, respectively, the information concerning the cartridge stored in the non-contact IC tag includes information concerning a color of the recording agent stored in the cartridge, and the control unit controls the actuator such that the actuator does not cause the cover member to open when the information concerning the color stored in the non-contact IC tag indicates a color different from a color that should be mounted on a corresponding mounting unit.

8. An image forming apparatus, comprising:

at least one cartridge that stores a recording agent and can be detachably mounted on a body of the image forming apparatus, the cartridge including an opening through which the recording agent stored in the cartridge is discharged and a shutter that closes the opening;

a non-contact IC tag that is attached to the cartridge for storing information concerning the cartridge to which the non-contact IC tag is attached;

at least one communication unit that is provided on the body of the image forming apparatus and communicates with the non-contact IC tag for transmitting and receiving information;

at least one actuator that comes in contact with the shutter for controlling an opening operation of the shutter; and at least one control unit that controls the actuator based on the information concerning the cartridge obtained through the communication unit, in which the shutter is slidable with respect to a cartridge body, and is opened when an operation for mounting the cartridge onto the body of the image forming apparatus is performed with the actuator being in contact with the shutter, the non-contact IC tag is attached to the shutter, the communication unit includes an antenna that is disposed at a position opposed to the non-contact IC tag when the cartridge is mounted, and the antenna and the non-contact IC tag are opposed to each other before and after the opening and closing operation of the shutter.

9. A cartridge storing a recording agent for an image forming apparatus, the cartridge having a shutter that covers an opening through which the recording agent stored is discharged, in which a non-contact IC tag in which information concerning the cartridge is recorded is attached to the shutter.

10. A method of mounting a cartridge storing a recording agent in an image forming apparatus, comprising:

inserting the cartridge into a mounting unit in a body of the image forming apparatus;

reading information concerning the cartridge that is stored in a non-contact IC tag attached to the cartridge from the non-contact IC tag; and causing an actuator to operate based on the information that is read, the actuator coming into contact with a cover member provided so as to close an opening through which a recording agent in the cartridge is discharged, to thereby control an opening operation of the cover member.

11. The method according to claim 10, in which the cover member is a shutter that is slidable with respect to a cartridge body, and after the actuator operates to come into contact with the cover member, the cartridge is moved to open the shutter.

12. The method according to claim 11, in which an antenna of a communication unit that reads information stored in the non-contact IC tag is opposed to the non-contact IC tag before and after the opening and closing operation of the shutter.

13. The method according to claim 12, in which the cartridge has a substantially cylindrical shape, and the cartridge is moved in the direction of an axis of a cylinder and is thereby mounted in the image forming apparatus, and is further rotated about the axis, and the shutter is opened by this rotation operation of the cartridge.

14. The method according to claim 11, in which the cartridge has a substantially box shape and the cartridge is inserted into the body of the image forming apparatus, and the shutter is opened by the inserting operation of the cartridge at an end stage of the inserting operation.

15. The method according to claim 10, in which the cover member is a stopper or a seal film that closes the opening of the cartridge, and the actuator is operated to pierce through the stopper or the seal film to open the opening.

16. The method according to claim 10, in which the image forming apparatus can form a multicolor image, and the method comprises;

inserting the cartridge into a mounting unit that is provided corresponding to each color in the body of the image forming apparatus, reading information concerning a color of the recording agent stored in the cartridge that is mounted from the non-contact IC tag attached to the cartridge that is mounted; and controlling the actuator such that the cover member is not opened when the information concerning the color that is read indicates a color different from a color that should be mounted in the mounting unit.

* * * * *